US009381668B2

(12) United States Patent
Banjo

(10) Patent No.: US 9,381,668 B2
(45) Date of Patent: Jul. 5, 2016

(54) LOG SPLITTING APPARATUS HAVING LOG SPLITTER FRAME WITH STRIPPER PLATES

(71) Applicant: Frictionless World LLC, Louisville, CO (US)

(72) Inventor: Daniel Banjo, Boulder, CO (US)

(73) Assignee: Frictionless World LLC, Westminster, CO (US)

( * ) Notice: Subject to any disclaimer, the term of this patent is extended or adjusted under 35 U.S.C. 154(b) by 541 days.

(21) Appl. No.: 13/887,975

(22) Filed: May 6, 2013

(65) Prior Publication Data

US 2014/0124097 A1 May 8, 2014

Related U.S. Application Data

(63) Continuation-in-part of application No. 29/436,770, filed on Nov. 8, 2012, now Pat. No. Des. 681,701.

(51) Int. Cl.
*B27L 7/06* (2006.01)
*B27L 7/00* (2006.01)

(52) U.S. Cl.
CPC .... *B27L 7/06* (2013.01); *B27L 7/00* (2013.01)

(58) Field of Classification Search
CPC ..... B27L 7/00; B27L 7/06
USPC ..... 144/193.2, 195.6, 195.8, 195.1, 195.7
See application file for complete search history.

(56) References Cited

U.S. PATENT DOCUMENTS 4,700,759 A 10/1987 Duerr
4,770,218 A * 9/1988 Duerr ..... B27L 7/00 144/195.1
4,782,870 A * 11/1988 Duerr ..... B27L 7/00 144/193.1
4,793,391 A * 12/1988 Mauer ..... B27L 7/06 144/195.1
D326,665 S 6/1992 Greenburg et al.
5,282,501 A * 2/1994 Miller, III ..... B27B 31/08 144/193.1
5,284,193 A 2/1994 Mires et al.
5,460,211 A * 10/1995 Minati ..... B27L 7/00 144/195.1
D544,505 S 6/2007 VanderBurgh et al.
7,255,143 B1 * 8/2007 Babcock ..... B27L 7/06 144/193.1
D585,915 S 2/2009 Feng
D617,354 S 6/2010 Banjo et al.
7,882,868 B2 2/2011 Lessard
D648,761 S 11/2011 Banjo et al.
2004/0250895 A1 12/2004 Marx
2005/0284540 A1 12/2005 Walker et al.
2005/0284541 A1 * 12/2005 Walker ..... B27L 7/00 144/193.2
2007/0000975 A1 1/2007 Paradise
2008/0251158 A1 10/2008 Koch
2009/0242078 A1 * 10/2009 Schamberger ..... B27L 7/00 144/195.1
2010/0024919 A1 * 2/2010 Majkrzak ..... B27L 7/00 144/195.1
2012/0132320 A1 * 5/2012 Blaha ..... B27L 7/06 144/366

* cited by examiner

*Primary Examiner* — Moshe Wilensky
*Assistant Examiner* — Onekki Jolly
(74) *Attorney, Agent, or Firm* — Marsh Fischmann & Breyfogle LLP; Jonathon A. Szumny

(57) ABSTRACT

A log splitting apparatus having stripper plates for stripping logs from a blade member as a piston is retracted into a cylinder. In one arrangement, the stripper plates are removably securable to opposing sides of a log splitter frame of the apparatus to allow for replacement of the stripper plates with other stripper plates or other components (e.g., stroke reducing devices), use of multi-way (e.g., 4-way) wedge systems, and/or the like.

10 Claims, 5 Drawing Sheets

LOG SPLITTING APPARATUS HAVING LOG SPLITTER FRAME WITH STRIPPER PLATES

RELATED APPLICATIONS

This application is a continuation-in-part of U.S. Design application Ser. No. 29/436,770, filed Nov. 8, 2012, entitled "LOG SPLITTER BEAM," and now U.S. Pat. No. D681,701, the entirety of which is hereby incorporated by reference.

FIELD

The present invention relates to a wood or log splitting apparatus and, more particularly, to a log splitter frame including stripper plates for dislodging logs during a return stroke of a splitting blade.

BACKGROUND

Continued popularity of wood as a source of heat has lead to increasing use of powered apparatus for wood splitting purposes. Many different forms of mechanical wood splitters have been developed. The most common design involves a frame mounted blade and platform arrangement wherein the blade, platform or both are driven toward and away from one another usually by a hydraulic cylinder. A wood block is placed between the blade and platform and the cylinder is activated to move the platform and blade together relative to one another thereby driving the blade through the wood block.

SUMMARY

Disclosed herein is an apparatus for splitting logs including an elongated beam, a mounting lug adjacent a first opposing end of the beam, a foot plate adjacent a second opposing end of the beam, and first and second stripper plates respectively removably mountable adjacent the first and second sides of the beam. In one arrangement, first and second mounting bracket assemblies may be secured or securable to the first and second sides of the beam, where the first and second stripper plates may be removably securable to the first and second mounting bracket assemblies to removably mount the first and second stripper plates adjacent the first and second sides of the beam. For instance, first and second bolt and nut assemblies may be used to removably secure the first and second stripper plates to the first and second mounting bracket assemblies, such as by inserting the bolts through aligned apertures through the stripper plates and mounting bracket assemblies and then threading the nuts onto the ends of the bolts.

Any of the embodiments, arrangements, and the like discussed herein may be used (either alone or in combination with other embodiments, arrangement, and the like) with any of the disclosed aspects. Any feature disclosed herein that is intended to be limited to a "singular" context or the like will be clearly set forth herein by terms such as "only," "single," "limited to," or the like. Merely introducing a feature in accordance with commonly accepted antecedent basis practice does not limit the corresponding feature. Moreover, any failure to use phrases such as "at least one" also does not limit the corresponding feature to the singular. Use of the phrase "generally," "at least generally," "substantially," "at least substantially" or the like in relation to a particular feature encompasses the corresponding characteristic and insubstantial variations thereof. Finally, a reference of a feature in conjunction with the phrase "in one embodiment" or the like does not limit the use of the feature to a single embodiment.

Reference will now be made to the following drawings, which assist in illustrating the various pertinent features of the various novel aspects of the present disclosure.

DETAILED DESCRIPTION

Figure 1A:
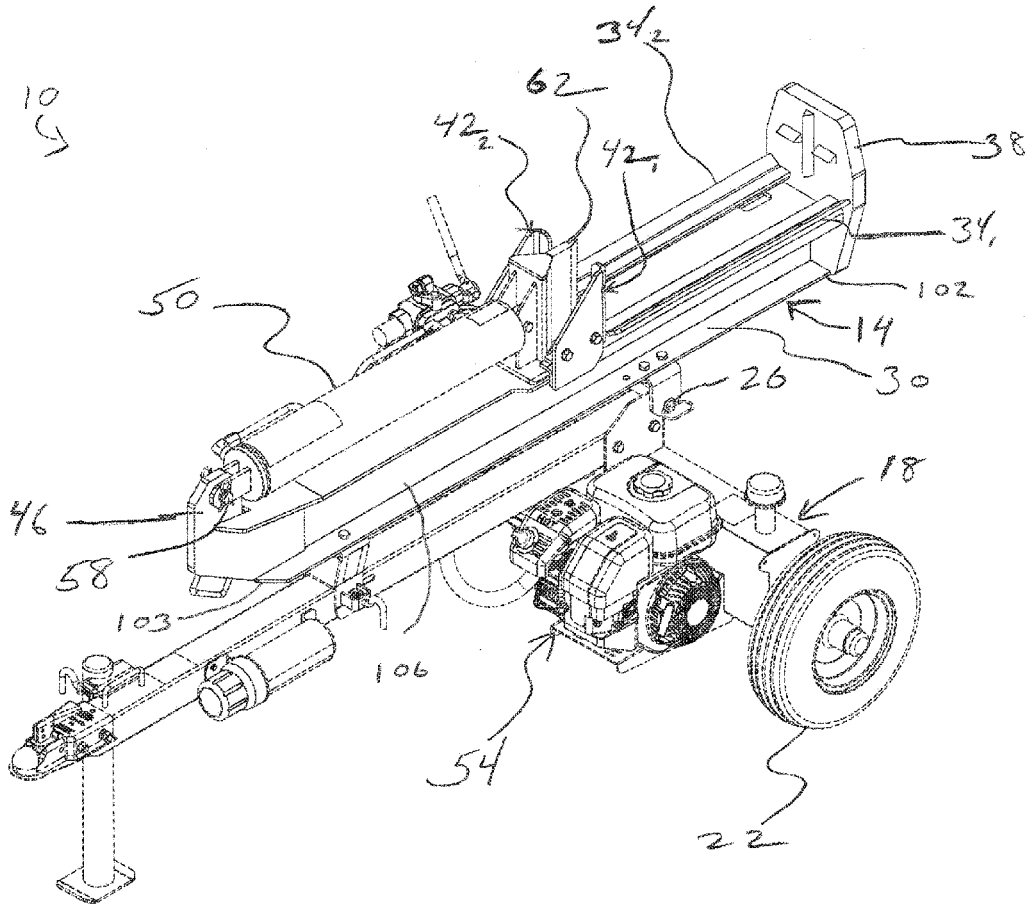
FIG. 1*a* is a perspective view of a log splitting apparatus according to one embodiment including a log splitter frame in a horizontal position.
Figure 1B:
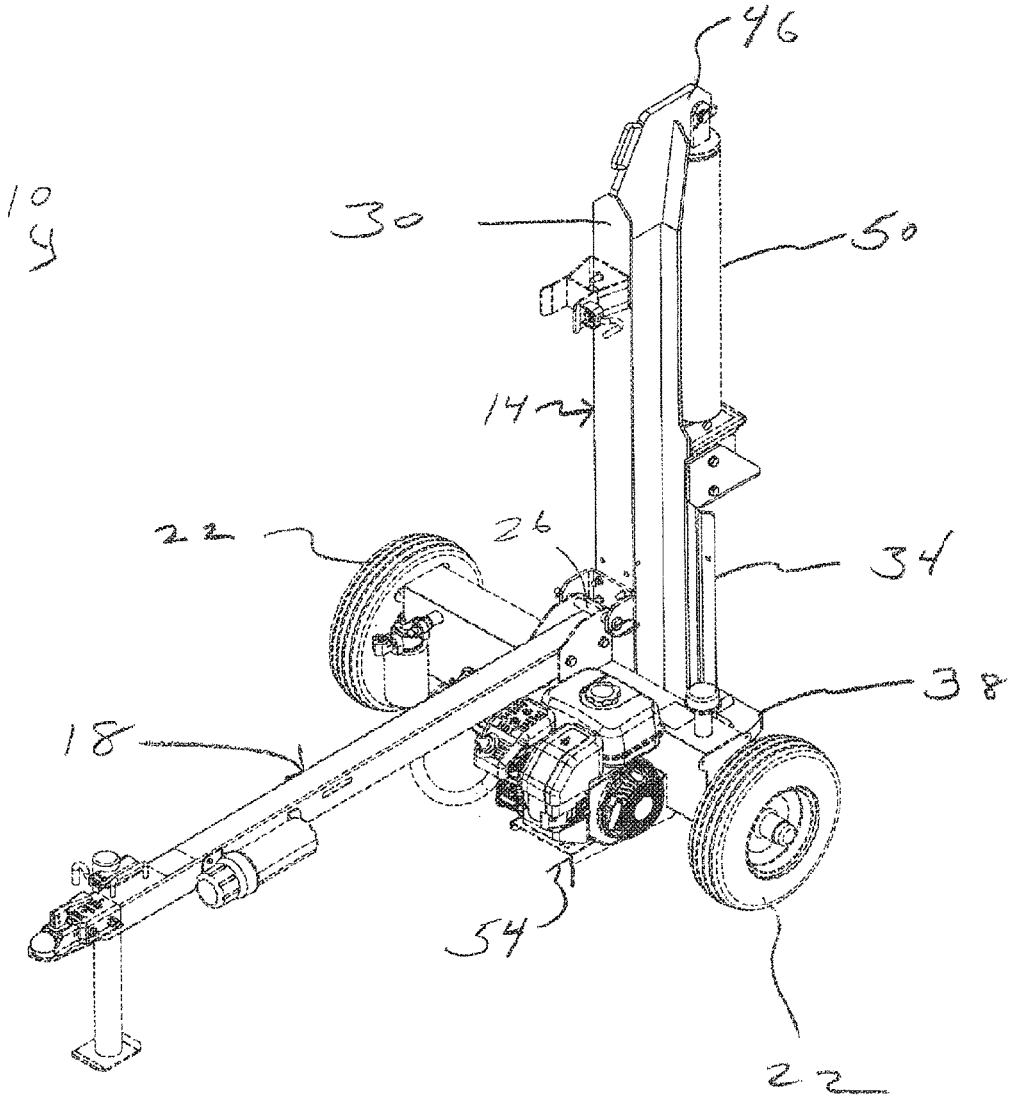
FIG. 1*b* is a perspective view similar to FIG. 1 but with the log splitter frame in a vertical position.

FIG. 1*a* is a perspective view of a log splitting apparatus 10 broadly including a log splitter frame 14 for splitting logs (not shown) placed thereon, where the log splitting frame 14 is mountable onto a carriage 18 having a pair of wheels 22 for supporting and facilitating transport of the frame 14. For instance, the log splitter frame 14 may be pivotally connected to the carriage 18 via pivot pin 26 for pivotal movement of the log splitter frame 14 between at least first and second positions, such as horizontal and vertical positions as shown in FIGS. 1*a* and 1*b*.

The log splitter frame 14 may broadly include a support beam 30 such as an I-beam or the like, such as including first and second opposite ends 102, 103, first and second opposite sides 106, 108, and top and bottom opposite platforms 110, 113). For instance, the top platform 110 may include opposite top and bottom surfaces 111, 112 and the bottom platform 113 may include opposite top and bottom surfaces 115, 117. The log splitter frame 14 may also include cradle members 34 (e.g., a pair of cradle members 34, such as first and second cradle members $\mathbf{34}_1$, $\mathbf{34}_2$) appropriately secured or securable to the beam 30 and collectively forming a cradle for supporting at least one log (not shown) placed thereon or therebetween, a foot plate 38 secured or securable generally adjacent a first end of the cradle members 34 for providing an opposing force against a log placed on the cradle members 34 and being pushed against the foot plate 38 by a blade member (discussed blow), and stripper plates 42 (e.g., a pair of stripper plates 42, such as first and second stripper plates $\mathbf{42}_1$, $\mathbf{42}_2$) secured (e.g., via welding) or removably securable (e.g., via bolt and nut assemblies) generally adjacent an opposing second end of the cradle members 34 and/or beam 30 for stripping split logs from the blade member as the same is retracted (e.g., due to twisted grain and/or other inconsistencies in the logs). The stripper plates 42 will be discussed in more detail later on in this disclosure.

The log splitter frame 14 may also include an anchoring member such as an attachment lug 46 (e.g., part of the beam 30) to which a hydraulic cylinder 50 may be removably secured (e.g., via pin 58). A drive assembly 54 (e.g., including an engine assembly, a hydraulic reservoir, etc.) may be fluidly interconnected to the hydraulic cylinder 50 via hydraulic lines (not labeled) for purposes of advancing and retracting a piston (not shown) within the hydraulic cylinder 50 to split logs placed on the cradle members 34. A blade member 62 (e.g., including a single wedge for splitting a log in two, two wedges substantially perpendicular to each other for splitting a log in four, etc.) may be appropriately secured or securable to the piston and designed to split a log placed on the cradle members 34. More specifically, advancement of the piston from a first position substantially within the hydraulic cylinder 50 (as in FIGS. 1*a*-1*b*) to a second position that is closer to the foot plate 38 causes the blade member 62 to urge the log against the foot plate 38 and then eventually split the log as the blade member 62 continues to advance towards the foot plate 38.

Figure 2:
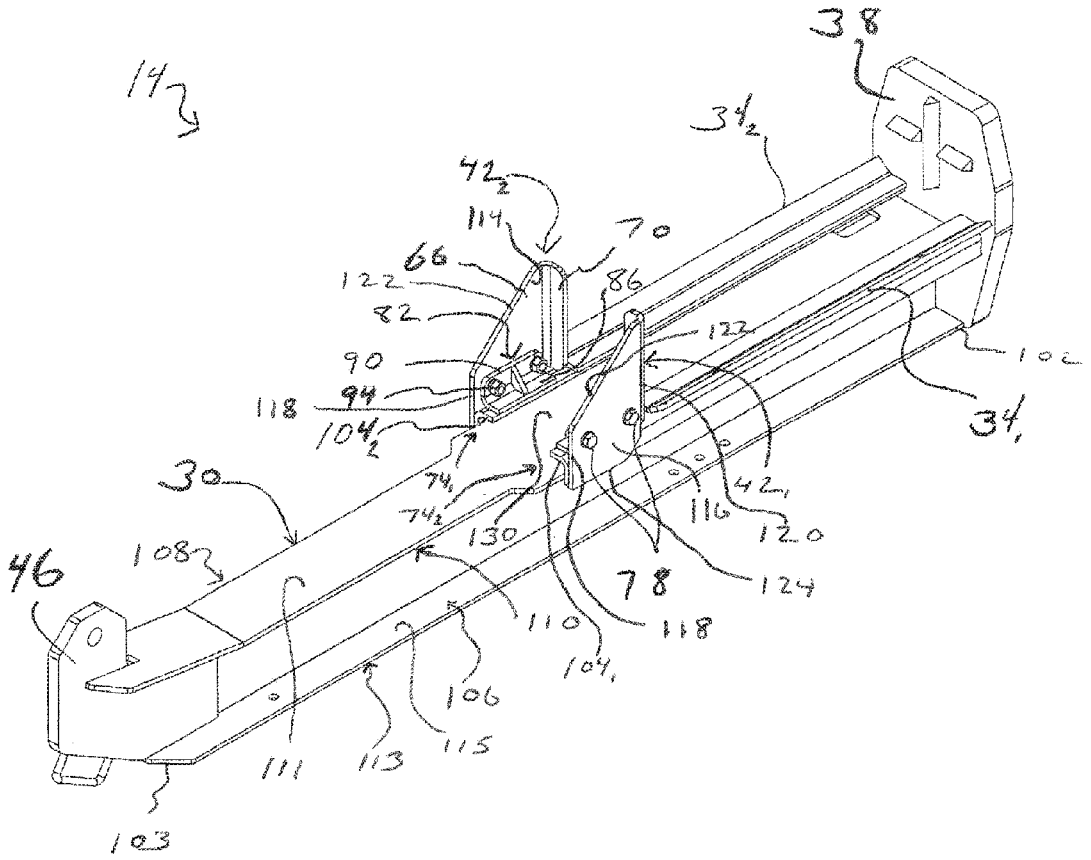
FIG. 2 is a perspective view of the log splitter frame of FIG. 1.
Figure 4:
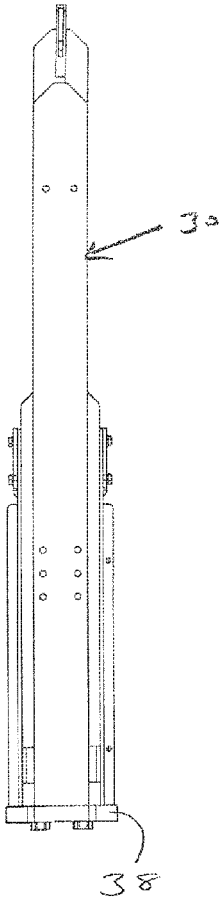
FIG. 4 is a bottom view of the log splitter frame of FIG. 2.

With specific reference now to FIG. 2, the first and second stripper plates $\mathbf{42}_1$, $\mathbf{42}_2$ may be secured or securable to opposing sides of the frame 14 so that the piston and blade member 62 can be passed therebetween, such as to the first and second opposing sides 106, 108 of the beam 30 (as shown in FIG. 2), to the opposing first and second cradle members $\mathbf{34}_1$, $\mathbf{34}_2$, and/or the like. Each stripper plate 42 may generally include a body portion 66 and a contact portion 70, where the body portion 66 generally provides stability to the contact portion as a log is being urged against the contact portion 70 during a return stroke of the piston (i.e., in a direction towards the lug 46) so as to strip the log from the blade member 62. For instance, each body portion 66 may generally extend perpendicularly from the top surface 111.

Figure 5:
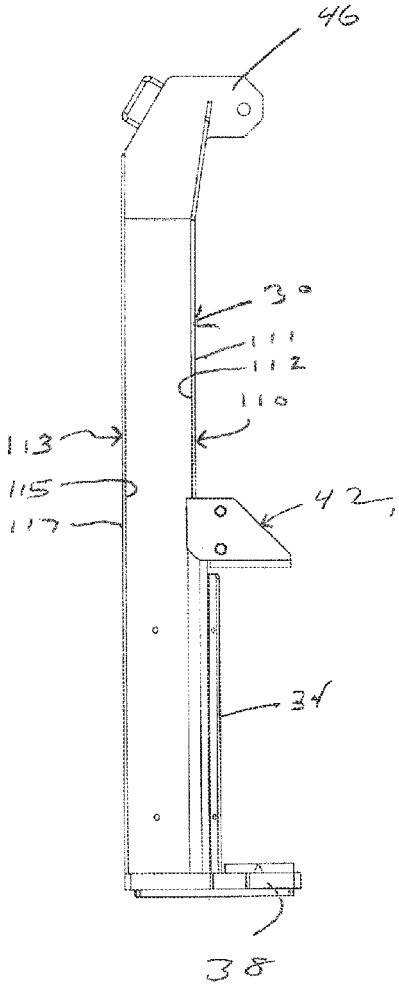
FIG. 5 is a right side view of the log splitter frame of FIG. 2.
Figure 3:
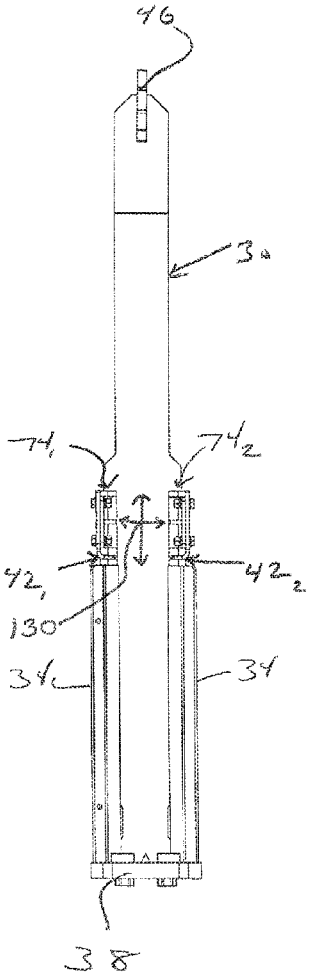
FIG. 3 is a top view of the log splitter frame of FIG. 2.
Figure 6:
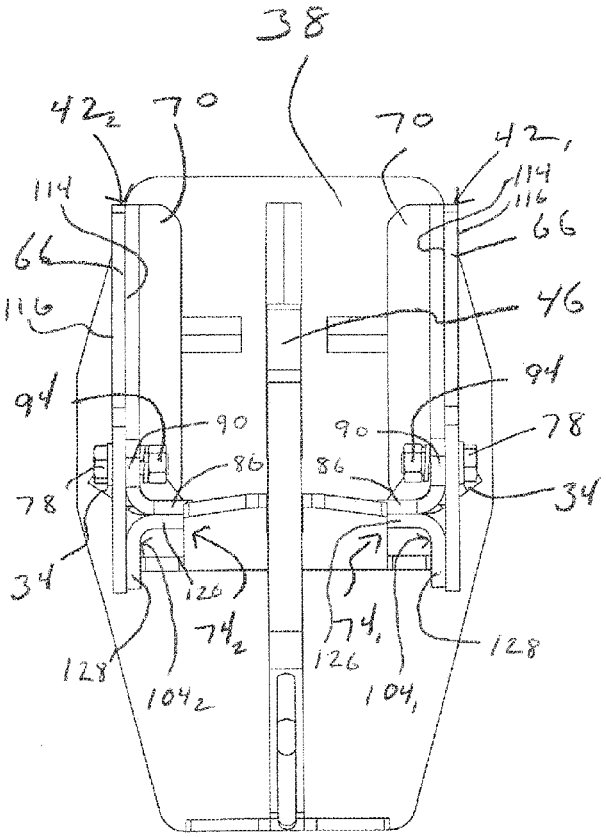
FIG. 6 is a front view of the log splitter frame of FIG. 2.
Figure 7:
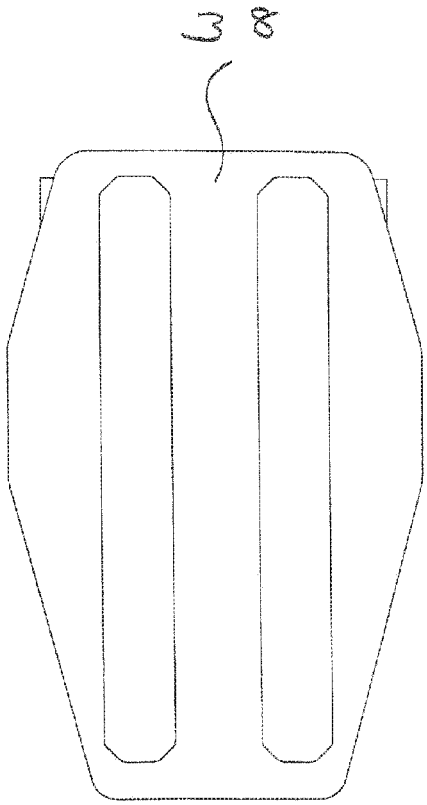
FIG. 7 is a rear view of the log splitter frame of FIG. 2.

The body portion 66 of the first stripper plate $\mathbf{42}_1$ may extend along the first side 106 of the beam 30 and include an inner surface 114, an opposite outer surface 116, a first side portion 118, an opposite second side portion 120, a top edge 122, and an opposite bottom edge 124. Similarly, the body portion 66 of the second stripper plate $\mathbf{42}_2$ may extend along the second side 108 of the beam 30 and include an inner surface 114, an opposite outer surface 116, a first side portion 118, an opposite second side portion 120, a top edge 122, and an opposite bottom edge 124. In one arrangement, the top edges 122 of the body portions 66 of the first and second stripper plates $\mathbf{42}_1$, $\mathbf{42}_2$ may be positioned above the top surface 111 of the top platform 110 of the beam 30 and the bottom edges 120 of the body portions 66 of the first and second stripper plates $\mathbf{42}_1$, $\mathbf{42}_2$ may be positioned below the top surface 111. See FIG. 5. In one embodiment, the top edge 122 may taper downwardly from the second side portion 120 to the first side portion 118.

The contact portions 70 of the first and second stripper plates $\mathbf{42}_1$, $\mathbf{42}_2$ may be respectively attached to and extend away from the body portions 66 of the first and second stripper plates $\mathbf{42}_1$, $\mathbf{42}_2$. For instance, the contact portion 70 of the first stripper plate $\mathbf{42}_1$ may be attached to the second side portion 120 of the body portion 66 between the top and bottom edges 122, 124 of the body portion 66, and the contact portion 70 of the second stripper plate $\mathbf{42}_2$ may be attached to the second side portion 120 of the body portion 66 between the top and bottom edges 122, 124 of the body portion 66. As another example, the contact portion 70 of the first stripper plate $\mathbf{42}_1$ may extend away from the body portion 66 of the first stripper plate $\mathbf{42}_1$ towards the contact portion 70 of the second stripper plate $\mathbf{42}_2$, and the contact portion 70 of the second stripper plate $\mathbf{42}_2$ may extend away from the body portion 70 of the second stripper plate $\mathbf{42}_2$ towards the contact portion 70 of the first stripper plate $\mathbf{42}_1$.

In one arrangement, and as shown, the body portions 66 of each of the first and second stripper plates $\mathbf{42}_1$, $\mathbf{42}_2$ may be a first plate, and the contact portions 70 may be a second plate (e.g., perpendicular to the first plate), where each of the first and second stripper plates $\mathbf{42}_1$, $\mathbf{42}_2$ is a single piece of material that is bent to form the first and second plates. While the contact portions 70 of the stripper plates 62 have been shown as being bent inwardly towards each other (e.g., and forming perpendicular angles to their respective body portions 66) so as to provide a substantially flat surface against which logs may be urged during the return stroke of the piston, it is to be understood that other shapes and forms of the contact portions 70 are also envisioned and encompassed within the scope of the present disclosure.

In one arrangement, each stripper plate 42 may be removably secured or attached to opposing sides of the frame 14. As an example, each of the first and second stripper plates $\mathbf{42}_1$, $\mathbf{42}_2$ may be attached to the beam 30 with respective first and second mounting bracket assemblies or arrangements $\mathbf{74}_1$, $\mathbf{74}_2$ that are respectively connected to the top surface 111 of the beam 30 and the body portions 66 of the first and second stripper plates $\mathbf{42}_1$, $\mathbf{42}_2$. In one embodiment, the first and second mounting bracket arrangements $\mathbf{74}_1$, $\mathbf{74}_2$ may be respectively connected to the first and second stripper plates $\mathbf{42}_1$, $\mathbf{42}_2$ and may extend towards each other. Furthermore, the first and second mounting bracket arrangements $\mathbf{74}_1$, $\mathbf{74}_2$ may be spaced by a gap 130 over the top surface 111 of the beam 30 along at least a portion of the length of the beam 30 (e.g., such as for positioning of a cylinder, piston, blade, etc., see FIG. 1*a*). For instance, an entirety of the first mounting bracket arrangement $\mathbf{74}_1$ may be spaced from an entirety of the second mounting bracket arrangement $\mathbf{74}_2$ by the gap 130. In one arrangement, the first stripper plate $\mathbf{42}_1$ and first mounting bracket arrangement $\mathbf{74}_1$ may be a first stripper plate unit and the second stripper plate $\mathbf{42}_2$ and second mounting bracket arrangement $\mathbf{74}_2$ may be a second stripper plate unit, where the first and second stripper plate units are spaced by the gap 130.

In one embodiment, each of the first and second mounting bracket arrangements $\mathbf{74}_1$, $\mathbf{74}_2$ may be respectively secured to (e.g., via welding) or securable to the first and second opposite sides 106, 108 of the beam 30. Also, each of the first and second mounting bracket arrangements $\mathbf{74}_1$, $\mathbf{74}_2$ may include one or more apertures therethrough (not shown) that are configured to align with respective apertures (not shown) through the body portions 66 of the stripper plates 42 for receipt of respective bolts 78 to secure the stripper plates 42 to the beam 30.

In one arrangement, each of the first and second mounting bracket arrangements $\mathbf{74}_1$, $\mathbf{74}_2$ may include at least a first bracket 82 including a mounting portion 86 that may be secured to the beam 30 (e.g., via welding the mounting portion 86 to the top of the beam 30 or to a flange 104 of the beam 30) or removably securable to the beam 14 (e.g., via aligned apertures and bolts, not shown), and an attachment portion 90 through which the apertures are disposed and to which the stripper plate 42 may be removably secured to (via a bolt 78 and respective nut 94). As shown, the mounting portion 86 may be disposed over the top surface 111 of the beam 30 while the attachment portion 90 may be disposed over and secured to the inner surface 114 of the body portion 66 (and may, like the body portion 66, extend generally perpendicularly relative to the top surface 111). For instance, the mounting and attachment portions 86, 90 may be perpendicular to each other as shown. As another example, the mounting portion 86 may be perpendicular to the body portion 66.

In one arrangement, a first flange $\mathbf{104}_1$ may be positioned between the first mounting bracket $\mathbf{74}_1$ and the beam 30 and a second flange $\mathbf{104}_1$ may be positioned between the second mounting bracket $\mathbf{74}_2$ and the beam 30. For instance, the first flange $\mathbf{104}_1$ may include a first portion 126 positioned between the mounting portion 86 of the first mounting bracket $\mathbf{74}_1$ and the beam 30, and a second portion 128 positioned between the inner surface 114 of the body portion 66 of the first stripper plate $\mathbf{42}_1$ and the beam 30. Also, the second flange 1042 may include a first portion 126 positioned between the mounting portion 86 of the second mounting bracket $\mathbf{74}_2$ and the beam 30, and a second portion 128 positioned between the inner surface 114 of the body portion 66 of the second stripper plate $\mathbf{42}_2$ and the beam 30. The first and second portions 126, 128 may be perpendicular to each other.

The attachment portion 90 may include an outer surface (not labeled) against which the inner surface 114 of the body portion 66 of a stripper plate 42 may be stably urged and mounted against as a nut 94 is threaded onto a respective bolt 78 (collectively, a nut and bolt assembly) and tightened against an opposing inner surface of the attachment portion 90. In another arrangement, each stripper plate 42 may be substantially directly removably secured to the beam 14 or cradle member 34 (e.g., via inserting a bolt 78 through aligned apertures in the stripper plate 42 and beam 14 and/or cradle member 34 and threading a nut 94 onto the bolt 78). While a few manners of removably securing the stripper plates 42 to the beam 30 or cradle members 34 has been disclosed, other manners of doing so are envisioned and encompassed herein.

Removability of the stripper plates 42 (e.g., via loosening the nuts 94 and removing the bolts 78 from the aligned apertures of the stripper plates 42 and mounting bracket arrangements 74 and/or in other manners) provides numerous advantages. In one regard, removability of the stripper plates 42 allows for efficient replacement of damaged stripper plates 42, replacement of the stripper plates 42 with different sized/configured stripper plates 42, and/or the like. In another regard, removability of the stripper plates 42 allows for replacement of the stripper plates 42 with other components (e.g., via inserting the bolts 78 through aligned apertures through the mounting bracket arrangements 74 and such other components). In one arrangement, the stripper plates 42 could be removed and replaced with any appropriate stroke reducing/limiting devices designed to dislodge shorter logs. For instance, the stroke reducing devices may essentially be in the form of stripper plates whose contact portions are disposed closer to the foot plate 38 than are the contact portions 70 of stripper plates 42 shown in FIG. 2. In one variation, the stroke reducing devices may be appropriately removably secured to the stripper plates 42 without removing the stripper plates 42 from the frame 14.

In a further regard, removability of the stripper plates 42 may allow for installation and use of any appropriate multi-way (e.g., 4-way) wedge system. For instance, in the case where the blade member 62 includes both vertical and horizontal wedges ("vertical" and "horizontal" being in relation to the orientation of the log splitter frame 14 in FIG. 1*a*), the horizontal wedge may not be able to fit through the space between the contact portions 70 of the stripper plates 42. In this regard, the stripper plates 42 may be appropriately removed from the frame 14 before the piston and blade member 62 are advanced. In one variation, the stripper plates 42 may be removed and replaced with stripper plates 42 sized/configured to allow for passage of a multi-wedge blade member 62 therebetween.

The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the disclosure herein. The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. An apparatus for splitting logs, comprising:

an elongated beam comprising first and second opposite ends, first and second opposite sides, and top and bottom opposite surfaces;

a mounting lug adjacent the first opposite end of the beam;

a foot plate adjacent the second opposite end of the beam;

a first stripper plate that includes:

a body portion that extends along the first side of the beam, wherein the body portion includes an inner surface, an opposite outer surface, a first side portion, an opposite second side portion, a top edge, and an opposite bottom edge; and a contact portion attached to and extending away from the body portion;

a first mounting bracket connected to the top surface of the beam and the body portion of the first stripper plate to removably mount the first stripper plate adjacent the first side of the beam;

a second stripper plate that includes:

a body portion that extends along the second side of the beam, wherein the body portion includes an inner surface, an opposite outer surface, a first side portion, an opposite second side portion, a top edge, and an opposite bottom edge; and a contact portion attached to and extending away from the body portion; and a second mounting bracket connected to the top surface of the beam and the body portion of the second stripper plate to removably mount the second stripper plate adjacent the second side of the beam;

wherein the contact portion of the first stripper plate extends towards the contact portion of the second stripper plate, wherein the contact portion of the second stripper plate extends towards the contact portion of the first stripper plate, wherein the first mounting bracket includes a mounting portion positioned over the top surface of the beam and an attachment portion positioned over the inner surface of the body portion of the first stripper plate, and wherein the second mounting bracket includes a mounting portion positioned over the top surface of the beam and an attachment portion positioned over the inner surface of the body portion of the second stripper plate.

2. The apparatus of claim 1, wherein the attachment portions of the first and second mounting brackets and the body portions of the first and second stripper plates are perpendicular to the top surface of the beam.

3. The apparatus of claim 1, further including:

a first flange positioned between the first mounting bracket and the beam; and a second flange positioned between the second mounting bracket and the beam.

4. The apparatus of claim 3, wherein the first flange includes a first portion positioned between the mounting portion of the first mounting bracket and the beam, wherein the first flange includes a second portion positioned between the inner surface of the body portion of the first stripper plate and the beam, wherein the second flange includes a first portion positioned between the mounting portion of the second mounting bracket and the beam, and wherein the second flange includes a second portion positioned between the inner surface of the body portion of the first stripper plate and the beam.

5. The apparatus of claim 4, wherein the first and second portions of the first flange are perpendicular, and wherein the first and second portions of the seconds flange are perpendicular.

6. The apparatus of claim 1, wherein the mounting portion and attachment portion of the first mounting bracket are perpendicular, and wherein the mounting portion and attachment portion of the second mounting bracket are perpendicular.

7. The apparatus of claim 6, wherein the body portion and contact portion of the first stripper plate are perpendicular, and wherein the body portion and contact portion of the second stripper plate are perpendicular.

8. The apparatus of claim 1, further including:

a first bolt extending through aligned apertures in the mounting portion of the first mounting bracket and the body portion of the first stripper plate; and a second bolt extending through aligned apertures in the mounting portion of the second mounting bracket and the body portion of the second stripper plate.

9. The apparatus of claim 8, wherein the top edges of the body portions of the first and second stripper plates are positioned above the top surface of the beam, and wherein the bottom edges of the body portions of the first and second stripper plates are positioned below the top surface of the beam.

10. An apparatus for splitting logs, comprising:

an elongated beam comprising first and second opposite ends, first and second opposite sides, and top and bottom opposite surfaces;

a mounting lug adjacent the first opposite end of the beam;

a foot plate adjacent the second opposite end of the beam;

a first stripper plate that includes:

a body portion that extends along the first side of the beam, wherein the body portion includes an inner surface, an opposite outer surface, a first side portion, an opposite second side portion, a top edge, and an opposite bottom edge; and a contact portion attached to and extending away from the body portion;

a first mounting bracket connected to the top surface of the beam and the body portion of the first stripper plate to removably mount the first stripper plate adjacent the first side of the beam;

a second stripper plate that includes:

a body portion that extends along the second side of the beam, wherein the body portion includes an inner surface, an opposite outer surface, a first side portion, an opposite second side portion, a top edge, and an opposite bottom edge; and a contact portion attached to and extending away from the body portion; and a second mounting bracket connected to the top surface of the beam and the body portion of the second stripper plate to removably mount the second stripper plate adjacent the second side of the beam;

wherein the contact portion of the first stripper plate extends towards the contact portion of the second stripper plate, wherein the contact portion of the second stripper plate extends towards the contact portion of the first stripper plate, and wherein the apparatus further includes:

a first bolt extending through aligned apertures in the first mounting bracket and the body portion of the first stripper plate; and a second bolt extending through aligned apertures in the second mounting bracket and the body portion of the second stripper plate.

* * * * *